US008869462B2

(12) United States Patent
Baron

(10) Patent No.: US 8,869,462 B2
(45) Date of Patent: Oct. 28, 2014

(54) TERMINATION POCKET FOR DECK

(75) Inventor: Dana Gavin Baron, Eustis, FL (US)

(73) Assignee: RussCo57, LLP, Norman, OK (US)

( * ) Notice: Subject to any disclaimer, the term of this patent is extended or adjusted under 35 U.S.C. 154(b) by 99 days.

(21) Appl. No.: 13/524,844

(22) Filed: Jun. 15, 2012

(65) Prior Publication Data

US 2013/0333306 A1 Dec. 19, 2013

(51) Int. Cl.
*E04B 5/48* (2006.01)

(52) U.S. Cl.
USPC ..... 52/62; 52/58; 52/60; 52/302.6; 52/97

(58) Field of Classification Search
CPC ..... E04B 5/48; E04B 1/70; E04B 1/92; E04B 7/26; E04B 7/14; E04B 7/16
USPC ..... 52/58, 62, 60, 59, 302.1, 302.6, 96, 97, 52/480, 481.1
See application file for complete search history.

(56) References Cited

U.S. PATENT DOCUMENTS

| | | | | |
|---|---|---|---|---|
| 1,992,123 | A * | 2/1935 | Hobbs | 52/58 |
| 2,733,787 | A * | 2/1956 | Morra | 52/97 |
| 2,755,894 | A * | 7/1956 | Weyl et al. | 52/97 |
| 3,838,544 | A * | 10/1974 | Hindall | 52/60 |
| 3,958,374 | A * | 5/1976 | Gobel | 52/60 |
| 4,741,132 | A * | 5/1988 | Emblin | 52/58 |
| 5,109,641 | A | 5/1992 | Halan | |
| 6,226,941 | B1 * | 5/2001 | Stevens | 52/302.3 |
| 6,385,932 | B1 * | 5/2002 | Melchiori | 52/302.3 |
| 6,401,402 | B1 * | 6/2002 | Williams | 52/58 |
| 6,481,164 | B1 | 11/2002 | McCorkel | |
| 6,725,617 | B2 * | 4/2004 | Cox | 52/408 |
| 7,383,669 | B2 * | 6/2008 | Morse | 52/545 |
| 7,451,571 | B2 | 11/2008 | Allen | |
| 7,600,944 | B1 * | 10/2009 | Keating | 405/96 |
| 7,685,779 | B1 | 3/2010 | Nelson | |
| 7,735,291 | B2 * | 6/2010 | Summy | 52/741.4 |
| 8,015,755 | B2 * | 9/2011 | Miller et al. | 52/97 |
| 8,099,911 | B2 * | 1/2012 | Anticich et al. | 52/58 |
| 2002/0088189 | A1 * | 7/2002 | Honda | 52/287.1 |
| 2003/0159379 | A1 | 8/2003 | Pickler | |
| 2009/0031640 | A1 * | 2/2009 | Elmes et al. | 52/60 |
| 2010/0212234 | A1 * | 8/2010 | Monteer | 52/95 |
| 2012/0110924 | A1 * | 5/2012 | Makin | 52/58 |

FOREIGN PATENT DOCUMENTS

| | | |
|---|---|---|
| JP | 11107464 | 4/1999 |
| JP | 2000038813 | 2/2000 |
| JP | 2000054479 | 2/2000 |

OTHER PUBLICATIONS

Photographs of other devices; relevant dates and disclosure information not known.

* cited by examiner

*Primary Examiner* — Phi A
(74) *Attorney, Agent, or Firm* — James Robert Johnson

(57) ABSTRACT

The present invention relates to flashing systems used to control and redirect water and, more specifically, to flashing systems used to control and redirect water from the junction of a deck with a wall or post. The present invention utilizes a set of flashing members and an upward facing pocket to create a system that drains water away from the decking assembly, including the support structure and decking.

7 Claims, 6 Drawing Sheets

TERMINATION POCKET FOR DECK

BACKGROUND

1. Field of the Invention

The present invention relates to flashing systems used to control and redirect water and, more specifically, to flashing systems used to control and redirect water from the junction of a deck with a wall or post.

2. Description of the Related Art

A common problem in the construction business is that of weatherproofing structural junctures, such as those between vertical walls or posts and roofs, decks, balconies, terraces and the like. Weatherproofing serves the goal of protecting the underlying structure from the damage associated with water seepage, e.g., rotting wood and cracking of masonry. The standard practice is to cover the seams associated with such junctures with flashing.

In applications for generally vertical structures such as decks, balconies, terraces and roofs with a low pitch, the prior flashing arrangements have been prone to leakage at best and commonly have been ineffective. Generally, such prior arrangements have left seams or junctures with cracks that allow water seepage and have not been effective at channeling or draining the water away from the support structure of the deck. Accordingly, it would be advantageous to have better flashing systems to control and redirect water away from the juncture and support structure.

SUMMARY OF THE INVENTION

In one embodiment of the invention there is provided a termination pocket for preventing intrusion of water at a junction of a generally vertical support structure and a deck. The deck has an upper surface; a first side in contact with the support structure and forming a first edge with the upper surface; and a second side connected to the first side at a generally right angle, forming a second edge with the upper surface and extending out from the support structure so that the first side, the second side and the upper surface form the junction with the support structure. The termination pocket comprises a set of flashing members connected in waterproof connections and covering the upper surface and the second side in the area around the junction and covering the support structure in the area around and above the junction. The termination pocket further comprises an upward facing pocket extending parallel to the second side and spaced from the second side wherein the upward facing pocket is connected to the set of flashing members such that a flashing bridge is formed extending from the upper surface to the upward facing pocket, thus creating a downward facing pocket between the second side and the upward facing pocket.

In another embodiment of the invention there is provided a deck assembly comprising a generally vertical support structure, a deck and a termination pocket. The deck has an upper surface; a first side in contact with the support structure, and forming a first edge with the upper surface; and a second side connected to the first side at a generally right angle. The second side forms a second edge with the upper surface and extends out from the vertical support structure so that the first side, the second side and the upper surface form a junction with the support structure. The termination pocket has a set of flashing members connected in waterproof connections and covering the upper surface and the second side in the area around the junction and covering the support structure in the area around and above the junction. The termination pocket further has an upward facing pocket extending parallel to the second side and spaced from the second side wherein the upward facing pocket is connected to the set of flashing such that a flashing bridge is formed extending from the upper surface to the pocket, thus creating a downward facing pocket between the second side and the upward facing pocket.

In yet another embodiment there is provided a termination pocket comprising a generally horizontal flashing member, a first generally vertical flashing member and a pocket flashing member. The generally horizontal flashing member has a top surface, a bottom surface, a first side edge, a second side edge, a front edge and a back edge, with the back edge being perpendicular to the first side edge. The first generally vertical flashing member extends from the bottom surface of the generally horizontal flashing member. The pocket flashing member has a first vertical wall having a top edge and a bottom edge; a second vertical wall having a top edge and a bottom edge; and a bottom extending from the bottom edge of the first vertical wall to the bottom edge of the second vertical wall. The first generally vertical flashing member is substantially parallel to and spaced from the first wall. The top edge of the first wall is attached to the first side edge of the generally horizontal flashing member.

BRIEF DESCRIPTION OF THE DRAWINGS

FIG. 6 is an elevation view taken along line 6 of FIG. 5.

DETAILED DESCRIPTION

Figure 1:
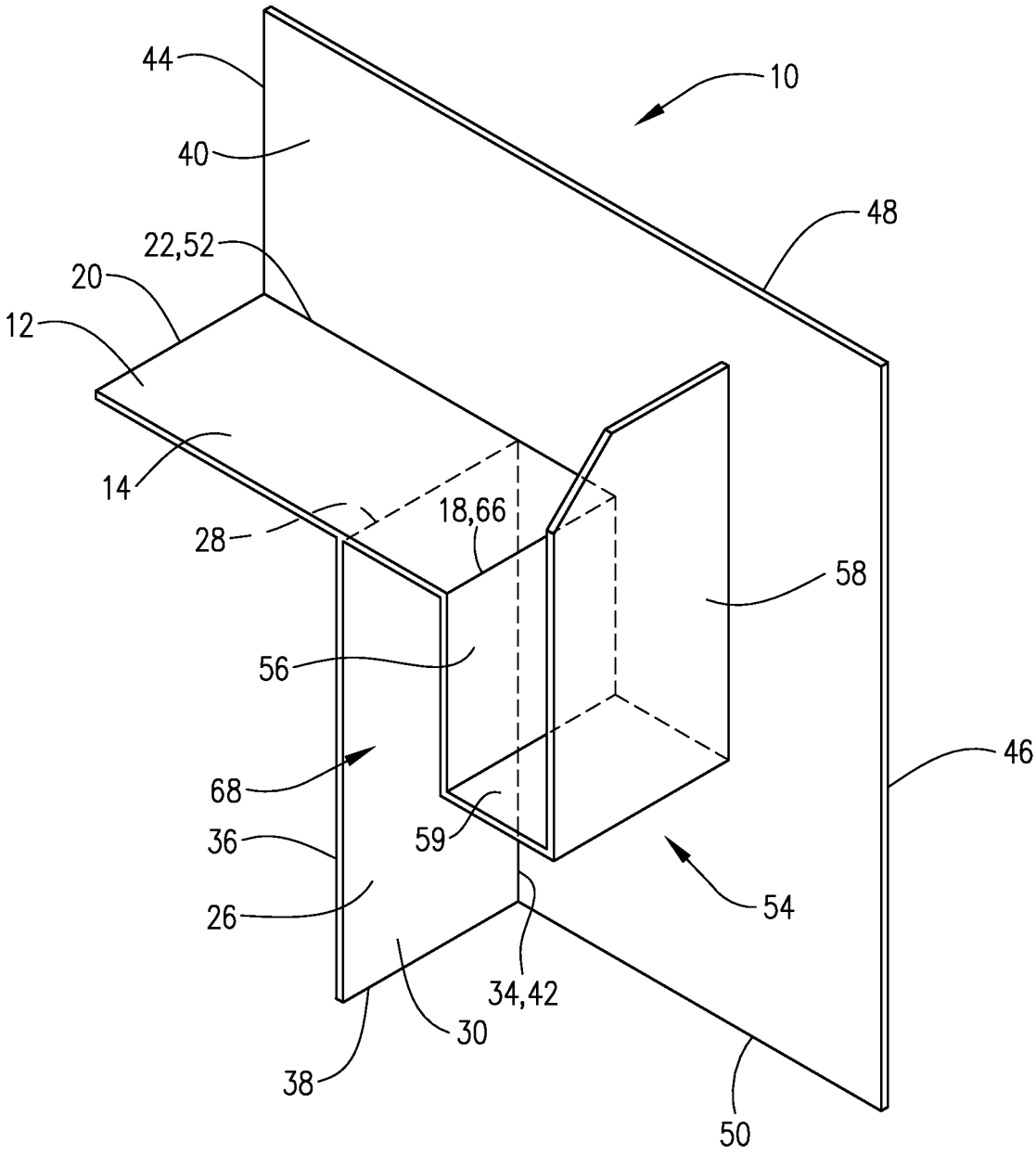
FIG. 1 is a perspective view of a termination pocket in accordance with one embodiment of the current invention.

As used herein, "deck" refers to a structural platform such as used in roofs, balconies, terraces and the like. "Support structure" generally means the structural element to which the deck is attached for support, for example, a wall, column or post. The inventive termination pocket is a set of flashing members and an upward facing pocket for use at the junction of a deck and a support structure to control and redirect water away from the ends of the deck and away from the support structure. Additionally, the inventive termination pocket creates a substrate to tie-in to for other structural and waterproofing components of the deck. The inventive termination pocket will now be more fully described with reference to the figures. Within the figures like components will generally be referred to with the same reference numerals even when referring to different embodiments.

Figure 2:
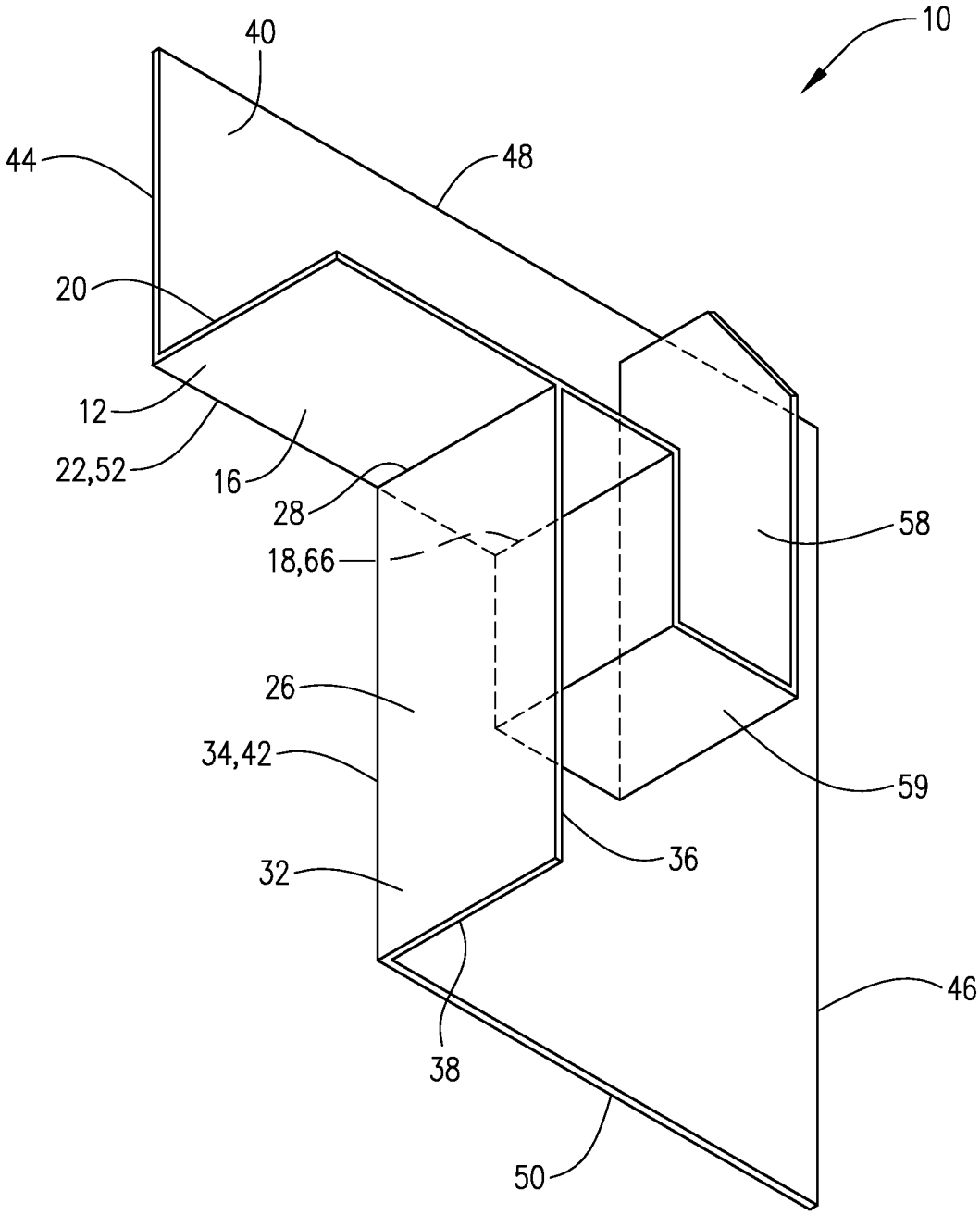
FIG. 2 is a perspective view of the embodiment of FIG. 1 from a different angle.

Referring now to FIGS. 1 and 2, a first embodiment of the present invention is shown generally by reference numeral 10. The termination pocket 10 has a set of flashing members connected with imperforated seams, i.e., the flashing members are connected so that the seams are waterproof and have no holes or gaps that could allow water seepage. The set of flashing members comprises a generally horizontal flashing member 12, first generally vertical flashing member 26 and second generally vertical flashing member 40.

Generally horizontal flashing member 12 has a top surface 14, a bottom surface 16, opposing side edges 18 and 20, back edge 22 and front edge 24, with back edge 22 and side edge 18 being perpendicular. First generally vertical flashing member 26 is connected to the bottom surface 16 at top edge 28. Additionally, first generally vertical flashing member 26 has opposing side surfaces 30 and 32, back edge 34, front edge 36 and bottom edge 38. Back edge 34 of first generally vertical flashing member 26 is connected to second generally vertical flashing member 40 at vertical edge 42. Additionally, second generally vertical flashing member 40 has vertical edges 44 and 46, top edge 48, bottom edge 50 and horizontal edge 52. Horizontal edge 52 of second generally vertical flashing member 40 is connected to the generally horizontal flashing member 12 at back edge 22.

As described above and shown in FIGS. 1 and 2, generally horizontal flashing member 12 and first vertical flashing member 26 form an inverted L-shape. This inverted L-shape is connected to second generally vertical flashing member 40 so that second generally vertical flashing member 40 extends above and to the backside of the inverted L-shape. As is further discussed below with regard to FIGS. 5 and 6, the resulting configuration for the set of flashing members snuggly fits into the junction of a support structure and deck covering the surrounding surfaces.

Returning now to FIGS. 1 and 2, termination pocket 10 further has an upward facing pocket 54. Upward facing pocket 54 generally will have opposing vertical walls 56 and 58, and a bottom 59 extending between the two vertical walls. Upward facing pocket 54 can have third vertical wall or back 60, which, as illustrated in FIGS. 1 and 2, can be the second generally vertical flashing member 40. Accordingly, opposing vertical walls 56 and 58 and back 60 define a top opening 62 (best seen in FIG. 6) and a front opening 64, which allow water to drain into upward facing pocket 54 through top opening 62 and out of upward facing pocket 54 through front opening 64; thus directing water away from the deck and support structure, as further described below. The opposing walls can be any suitable height, e.g., equal height, wall 56 extending higher than wall 58 or wall 58 extending higher than wall 56. However, in the illustrated embodiment, wall 58 extends higher than wall 56 so that upward facing pocket 54 is a J-shaped flashing member. The J-shaped configuration provides protection from water entering upward facing pocket 54 spilling over wall 58.

Upward facing pocket 54 is connected at the top edge 66 of wall 56 to generally horizontal flashing member 12 so as to define a downward facing pocket 68 by first generally vertical flashing member 26, upward facing pocket 54 and generally horizontal flashing member 12. The portion of horizontal flashing member 12 extending between first generally vertical flashing member 26 and wall 56 serves as a bridge extending from deck 76 to upward facing pocket 54, as will be more fully appreciated by reference to FIGS. 3 and 6. Additionally, in the embodiment of FIGS. 1 and 2, second generally vertical flashing member 40 extends across the back of downward facing pocket 68 and is connected thereto by imperforated seams so as to prevent water intrusion to the surface adjacent to the back of second generally vertical flashing member 40.

As will be appreciated, the embodiment of termination pocket 10 illustrated in FIGS. 1 and 2 is for use with a wall that extends beyond the side of the deck to which the termination pocket 10 is attached. Thus, the deck and deck side are received in the afore described inverted L-shape at the junction of the deck and wall, and second generally vertical flashing member 40 extends along the wall above the junction and around the side of the deck to thus protect the wall from water intrusion.

Figure 3:
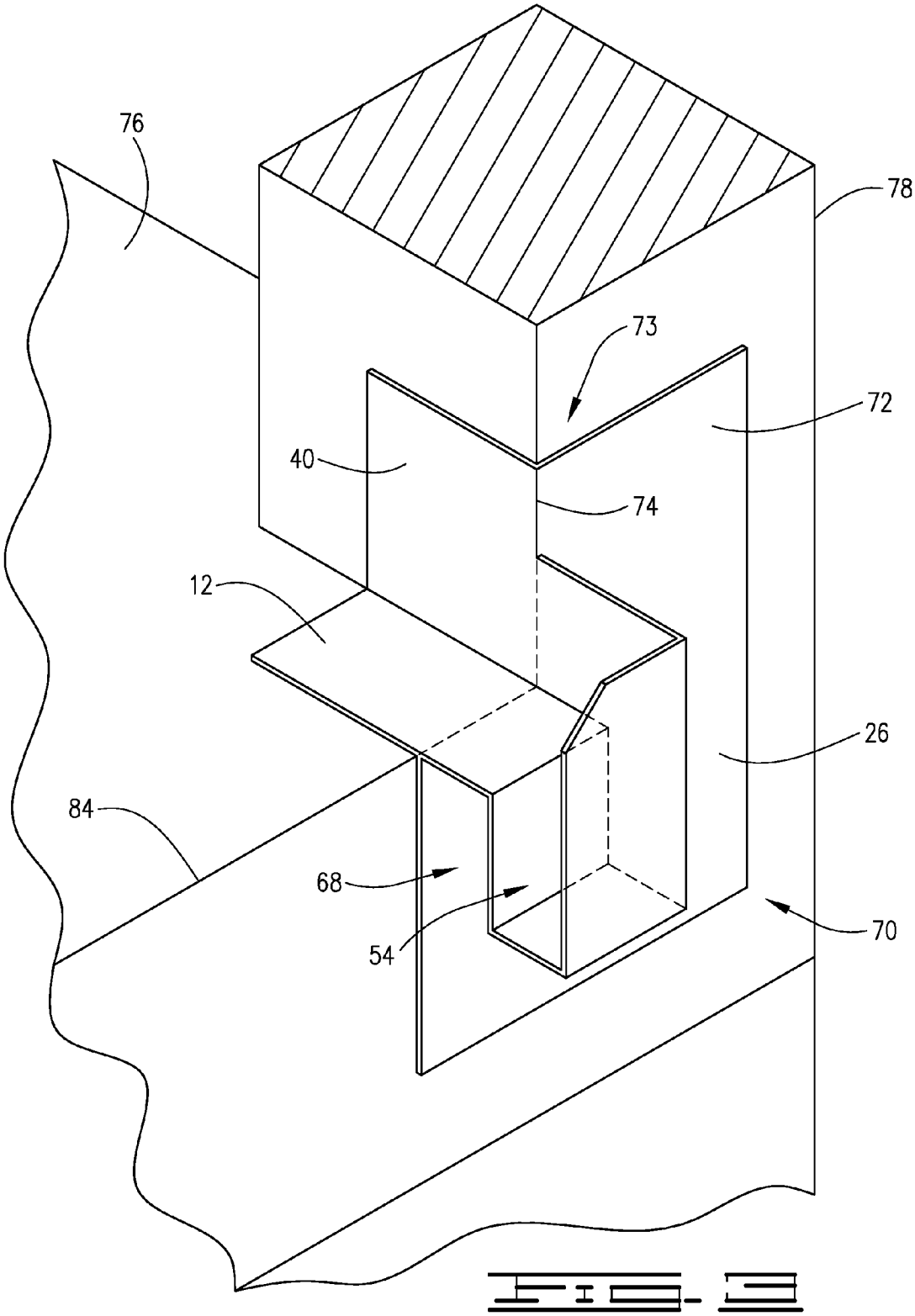
FIG. 3 is a perspective view of a termination pocket in accordance with another embodiment of the current invention. The termination pocket illustrated is shown attached to a support column and a deck.
Figure 4:
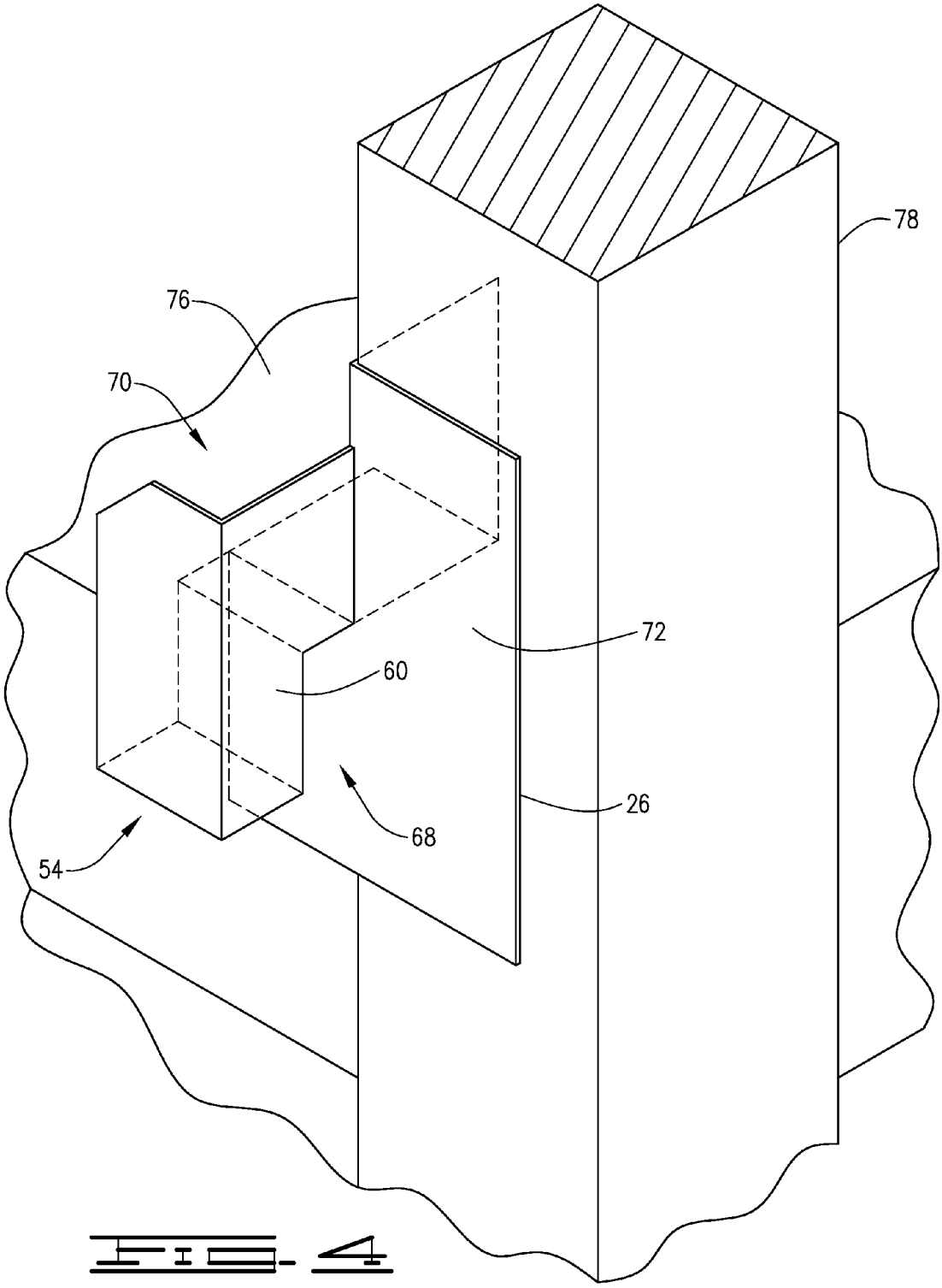
FIG. 4 is a perspective view of the embodiment of FIG. 3 from a different angle.

Turning now to FIGS. 3 and 4, a termination pocket 70 is illustrated. Termination pocket 70 is useful where support structure 78 is a column or beam support structure or to wall support structure where a wall corner is located at the wall deck junction. For termination pocket 70, like components have been labeled with like reference numerals to those of termination pocket 10. For termination pocket 70, first generally vertical flashing member 26 extends behind second generally vertical flashing member 40 and has an L-shaped configuration so that the upper portion 72 of the L-shaped configuration extends above generally horizontal flashing member 12 on the back side of second generally vertical flashing member 40. Thus, first and second generally vertical flashing members 26 and 40 form a corner flashing piece 73 having imperforated seam 74 so as to at least partially encase the corner of the wall, column or beam above generally horizontal flashing member 12. Additionally, downward facing pocket 68 can have a back or be open on both front and back as illustrated in FIGS. 3 and 4.

Figure 5:
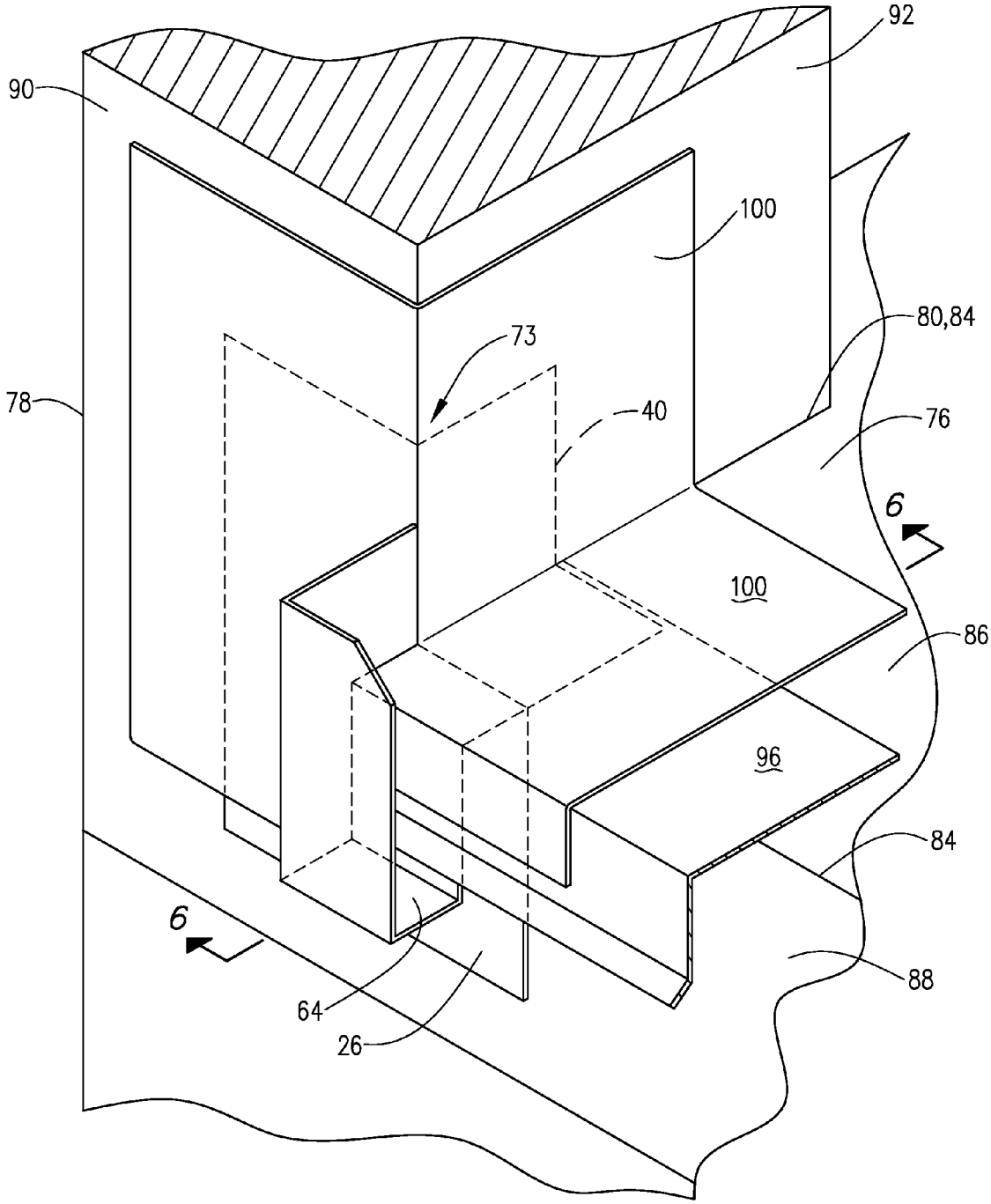
FIG. 5 is a perspective view of a termination pocket in accordance with an embodiment of the current invention. The termination pocket is illustrated as installed on a deck.
Figure 5:
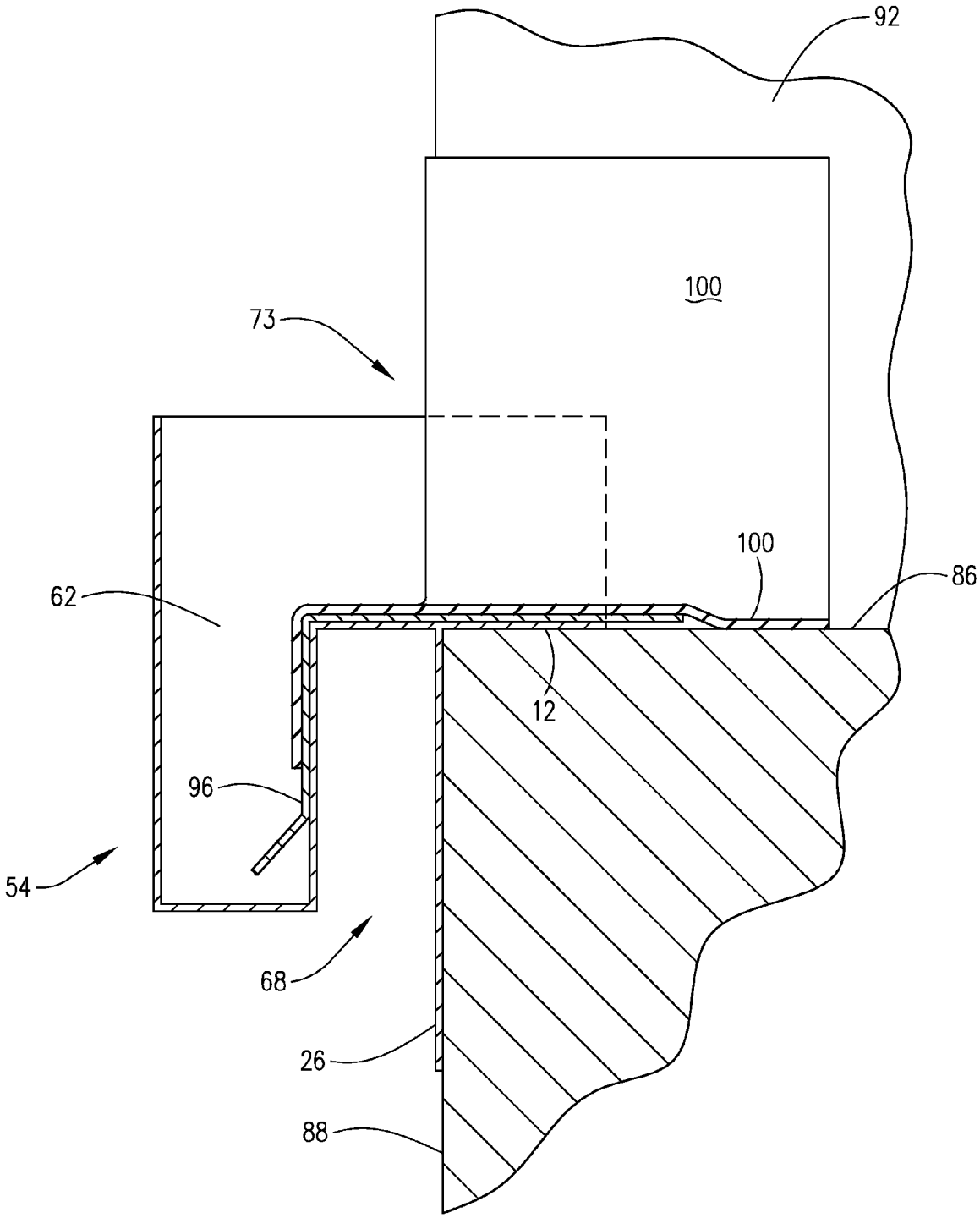

Turning now to FIGS. 5 and 6, an installed termination pocket 70 is illustrated. In FIGS. 5 and 6, a deck 76 is connected along one side to a generally vertical support structure 78, in this case a column or beam. The connection is along edge junction line 80 located where edge 84 of deck 76 meets with support structure 78. In past flashing systems, edge junction 80 has been particularly problematic with respect to water seepage due to numerous seams and junction points in the flashing and because of inadequate direction of water away from edge junction 80.

Termination pocket 70 is located at edge junction 80 such that the inverted L-shape formed by first generally vertical flashing member 26 and generally horizontal flashing member 12 is mated with the inverted L-shape formed by upper surface 86 and side 88 of deck 76. Additionally, corner flashing piece 73 is mated with sides 90 and 92 of support structure 78. Because the flashing members are joined with imperforated seams, the seams and area around the junctions are covered by flashing members 12, 26 and 40 in a waterproof layer.

Generally horizontal flashing member 12 extends out from the upper surface 86 of deck 76 to form a bridge to upward facing pocket 54 such that water tends to flow off upper surface 86 out and away from the deck to upward facing pocket 54. Upward facing pocket 54 channels the water away from the support structure and can be connected at opening 64 to a gutter or other drainage system. To ensure drainage away from the support structure, upward facing pocket 54 can have a slope. As will be appreciated from the drawings, downward facing pocket 68, allows for the installation of further flashing, fascia boards, siding and other decking components between the upward facing pocket 54 and first generally vertical flashing member 26. Also, among other advantages, downward facing pocket helps ensure that water is channeled away from the deck.

Generally, the upward facing pocket 54 and downward facing pocket 68 can be any size and shape to ensure adequate control and redirection of water away from the support structure and deck. Typically, the slope of upward facing pocket 54 will be downward from the back 60 to the front opening 64 at about 5 degrees from horizontal but can be from about 2 degrees to 45 degrees, or from about 2 degrees to about 10 degrees or from about 4 degrees to about 7 degrees. Upward facing pocket 54 can generally have a width of about 1.25 inches but can have a width of from 0.5 inch or greater, and can be about 0.5 inch to a about 2.0 inches or can be from about 1.0 inch to about 1.5 inches. Downward facing pocket 68 will generally have a width of about 1.0 inch but can have a width of about 0.5 inch or greater and can be about 0.5 inch to about 1.5 inches or can be from about 0.75 inch to about 1.25 inches. Additionally, typically, wall 58 of upward facing pocket 54 will be greater in height than wall 56. As illustrated, wall 58 can have its greatest height near back 60 of upward facing pocket 54 and can angle down to a lower height towards front opening 64. This lower height can be the same height as wall 56 or, preferably, can be greater in height than wall 56. Thus, adjacent to back 60, wall 58 can be about 2.25 inches greater in height than wall 56 and can, more generally, be about 1 inch to about 3 inches greater than the height of wall 56, or can be about 2 inches to about 2.5 inches greater than the height of wall 56. Adjacent to front opening 64, wall 58 can be about 1.75 inches greater in height than wall 56 and can, more generally, be about 0.5 inch to about 3 inches greater than the height of wall 56, or can be about 1 inch to about 2.5 inches greater than the height of wall 56. The inventive termination pocket can be made from any suitable material. Generally, the material can be selected from materials that can be cast, molded and/or welded, such as metals plastics, polymers and carbon composites. Generally, most metals are suitable for use as the material, but typically the material can be selected from the group comprising aluminum, copper and galvanized steel. More preferably, the material can be aluminum.

The size of the flashing members can depend on the particular decking and support structure and will be apparent to one skilled in the art based on the disclosure herein. Generally, the flashing members can extend out from the edge junction at least about 2 inches and can be from about 2 inches to about 5 inches.

Returning now to FIGS. 5 and 6, the installation of the termination pocket on a deck with additional flashing elements and water membranes can be seen. In FIGS. 5 and 6, termination pocket 70 is installed as described above. A second set of flashing members can further cover the deck and surface of the support structure. The second set of flashing members can comprise flashing edge piece 96, which covers at least a portion of the upper surface of deck 76, extends out over edge 84, across downward facing pocket 68 and over into upward facing pocket 54. Additional flashing members can be installed along the upper surface and support structure so as to extend over a portion of the wall adjacent to junction line 80 and overlapping on top of second generally vertical flashing member 40 (not seen in FIG. 6). A water resistant or waterproof membrane known in the art, such as membrane 100, can be on top of the second set of flashing members and on portions of the deck and support structure not covered by flashing.

Other embodiments of the current invention will be apparent to those skilled in the art from a consideration of this specification or practice of the invention disclosed herein. Thus, the foregoing specification is considered merely exemplary of the current invention with the true scope thereof being defined by the following claims.

What is claimed is:

1. A deck assembly comprising:

a generally vertical support structure;

a deck having:

an upper surface, a first side in contact with the support structure, and forming a first edge with the upper surface; and a second side connected to the first side at a generally right angle, forming a second edge with the upper surface and extending out from the support structure to that the first side, the second and the upper surface form a junction with the support structure; and a termination pocket of unitary construction having:

a set of flashing members connected in waterproof connections and covering the upper surface and covering the second side in the area around the junction and the support structure in the area around and above the junction; and an upward facing pocket extending parallel to the second side and spaced from the second side wherein the upward facing pocket is connected to the set of flashing members such that a flashing bridge is formed extending from the upper surface to a first vertical wall of the upward facing pocket and, thus creating a downward facing pocket between the second side and the upward facing pocket, said downward facing pocket being formed from the flashing member covering the second side, the flashing bridge to the upward facing pocket and the first vertical wall of the upward facing pocket, said downward facing pocket thereby being positioned between the second side and the upward facing pocket and running parallel to the upward facing pocket.

2. The deck assembly of claim 1 wherein the upward facing pocket is spaced from the second side from about 0.5 inch to about 1.0 inches.

3. The deck assembly of claim 1 wherein the upward facing pocket has a bottom, two sides and a back to this define a top opening and a front opening, the front opening opposing the back and wherein the upward facing pocket is oriented to that the back is closer to the support structure than the front opening.

4. The deck assembly of claim 3 wherein the bottom of the upward facing pocket is sloped downward from about 2 degrees to about 45 degrees from the back to the front opening.

5. The deck assembly of claim 1 wherein the support structure is a wall, which extends behind the upward facing pocket and the set of flashing members are connected to the upward facing pocket and downward facing pocket so that the set of flashing members covers the area behind and around the upward facing pocket and downward facing pocket.

6. The deck assembly of claim 1 wherein the support structure is a beam and the set of flashing members covers the beam around, above and at least partially below the junction.

7. The deck assembly of claim 1 wherein a second set of flashing members cover at least a portion of the upper surface of the deck and extend into the upward facing pocket.

* * * * *